United States Patent [19]

Helm et al.

[11] Patent Number: 4,948,133

[45] Date of Patent: Aug. 14, 1990

[54] MACHINES FOR GAMING, AMUSEMENT, EDUCATION AND THE LIKE

[75] Inventors: Arthur E. Helm, Southport; Stuart J. Keane, Leeds, both of England

[73] Assignee: Elton Fabrications Limited, Merseyside, England

[21] Appl. No.: 362,928

[22] Filed: Jun. 8, 1989

Related U.S. Application Data

[63] Continuation-in-part of Ser. No. 119,339, Nov. 10, 1987, abandoned.

[30] Foreign Application Priority Data

Nov. 12, 1986 [GB] United Kingdom ..... 8627053

[51] Int. Cl.[5] ..... A63F 7/06

[52] U.S. Cl. ..... 273/85 G; 273/86 R; 273/86 B

[58] Field of Search ..... 273/86 R, 86 B, 86 F, 273/86 G, 86 H, 1 GC, 352, 1.5 R, 1 E, 1

[56] References Cited

U.S. PATENT DOCUMENTS

| | | | |
|---|---|---|---|
| 443,631 | 12/1890 | Hamilton | 273/86 R |
| 2,197,520 | 4/1940 | Ebert | 273/86 R |
| 2,614,840 | 10/1952 | Monkres | 273/86 R |
| 2,621,042 | 12/1952 | Stein et al. | 273/86 R |
| 2,750,683 | 6/1956 | Theobald | 273/86 H |
| 2,806,701 | 9/1957 | Durant | 273/352 |
| 2,977,429 | 3/1961 | Zimmerman | 273/352 |
| 3,582,074 | 6/1971 | Menotti | 273/86 H |
| 3,834,702 | 9/1974 | Bliss | 273/86 H |
| 4,461,475 | 7/1984 | Nakamura | 273/1 GC |

*Primary Examiner*—Edward M. Coven
*Assistant Examiner*—Dean Small
*Attorney, Agent, or Firm*—Fred Philpitt

[57] ABSTRACT

A gaming apparatus comprising a plurality of gaming machines is provided. Each machine can be operated individually, the player upon each start of the machine endeavouring to reach a predetermined objective by his skill in propelling a ball into apertures to reach a predetermined total before a counting device in the machine which is started upon starting of the machine, reaches that total. The player thus competes against the machine in individual operation thereof. In the embodiment described the counting device is a clock hand which sweeps across a clock face. The players performance is indicated by a clock hand sweeping across the same clock face. The clock face and both hands are visible to the player to provide excitement.

All of the machines can be ganged so that the players play against each other, but in this case the counting devices of the respective machines are rendered inoperative and the winner is the first player to make his clock hand reach the predetermined total.

6 Claims, 13 Drawing Sheets

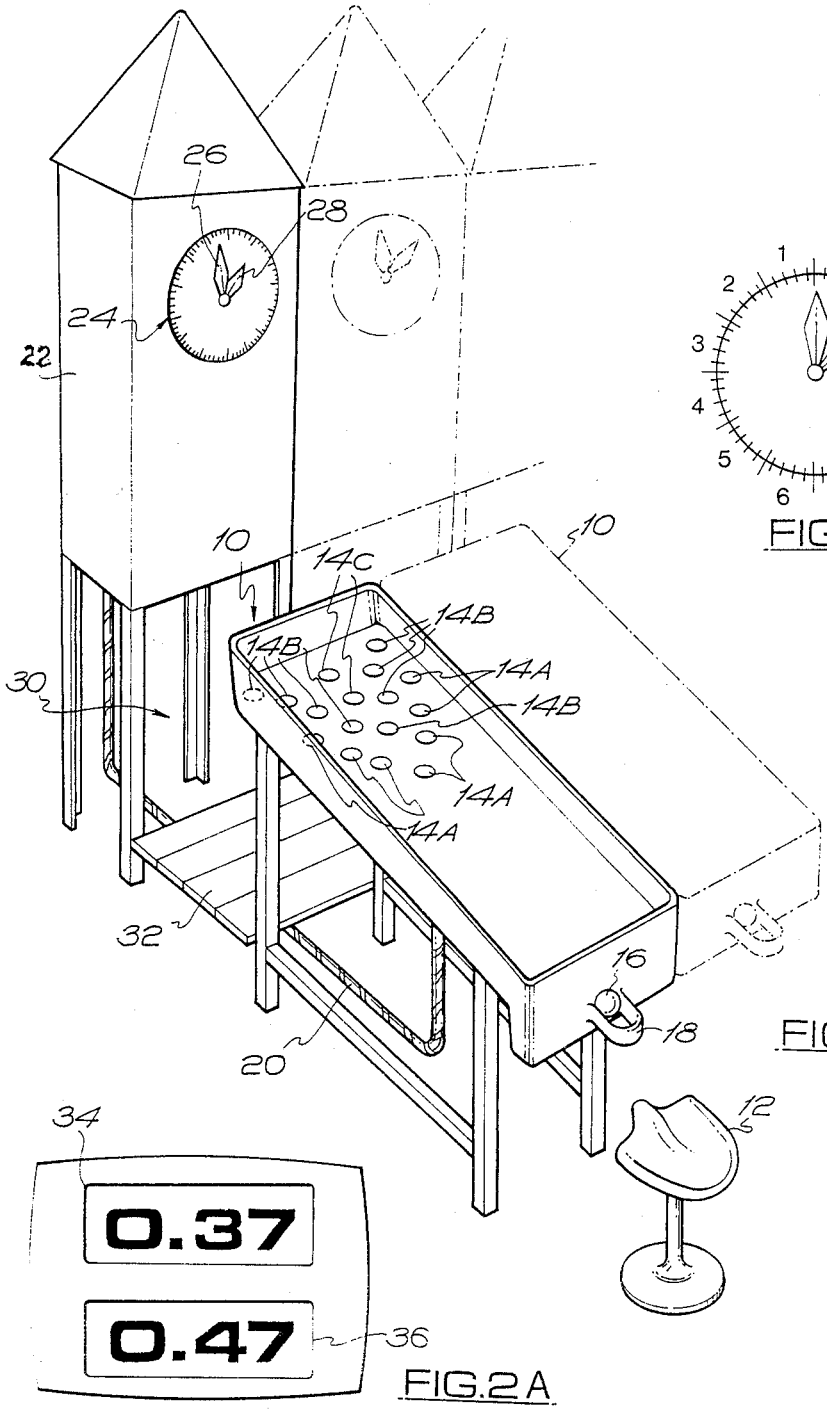
FIG.1
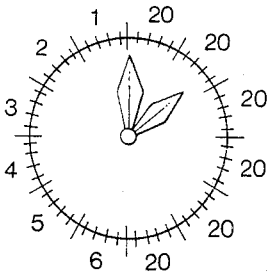
FIG.2
FIG.2A

| | RAM 6116 | EPROM SKT | MPU 6502 | VIA A 6522 | VIA B 6522 |
|---|---|---|---|---|---|
| +5V | 24 | 26,27,28 | 8 | 20 | 20 |
| GND | 12 | 14 | 1&21 | 1 | 1 |
| Φ2 | - | - | 39 | 25 | 25 |
| $\overline{IRQ}$ | - | - | 4 | 21 | 21 |
| D0 | 9 | 11 | 33 | 33 | 33 |
| D1 | 10 | 12 | 32 | 32 | 32 |
| D2 | 11 | 13 | 31 | 31 | 31 |
| D3 | 13 | 15 | 30 | 30 | 30 |
| D4 | 14 | 16 | 29 | 29 | 29 |
| D5 | 15 | 17 | 28 | 28 | 28 |
| D6 | 16 | 18 | 27 | 27 | 27 |
| D7 | 17 | 19 | 26 | 26 | 26 |
| A0 | 8 | 10 | 9 | 38 | 38 |
| A1 | 7 | 9 | 10 | 37 | 37 |
| A2 | 6 | 8 | 11 | 36 | 36 |
| A3 | 5 | 7 | 12 | 35 | 35 |
| A4 | 4 | 6 | 13 | | |
| A5 | 3 | 5 | 14 | | |
| A6 | 2 | 4 | 15 | | |
| A7 | 1 | 3 | 16 | | |
| A8 | 23 | 25 | 17 | | |
| A9 | 22 | 24 | 18 | | |
| A10 | 19 | 21 | 19 | | |
| A11 | - | 20/23 | 20 | | |
| A12 | - | 2 | 22 | | |

MACHINES FOR GAMING, AMUSEMENT, EDUCATION AND THE LIKE

This application is a Continuation-in-part of Ser. No. 07/119339 filed Nov. 10, 1987, abandoned Jul. 13, 1989.

This invention relates to a machine for use in gaming, amusement, education, competition and the like being of the type operated by a player and the object of which is to ascertain if the player can reach a particular goal in the play of the machine. The achievement of that goal may for example result in the winning of a competition, the collection of a prize, the assessment of a person's ability or any other achievement which may be selected. In specific embodiments, the value of the prize when provided, is related to the speed at which the player can reach said goal.

As the main utilisation of the machines to which the invention relates, as far as the inventor is concerned, comprises the provision of a prize on the reaching of a goal, the description which follows herein will be limited to describing the machine as a gaming machine, but it is to be borne in mind, as will be clearly understood from the description, that the principles of the invention, except where the context permits of no other interpretation, are applicable to an extremely wide range of machines which can operate according to the principles of the invention.

In a known gaming machine, play of the machine involves the participation of a number, say 15 to 20 players, each of which sits in front of his or her own table. The table is arranged as a form of bagatelle and the player rolls a ball across the table with the object of having the ball drop into holes provided in the table. Depending upon which hole the ball drops into, so the player achieves a point rating being 1, 2 or 3 points. For each point achieved by a player, a corresponding play component moves along a track by one step, and quite simply the object of the game is to have the players compete against each other and the winner being established when his movable component has moved from a common starting line and is first to a common finishing line a number of steps, for example 25 to 50, away from the starting line.

Such games are commonly known as "Derbys" insofar as the movable components are usually model horses or the like and are arranged in alignment at the starting line at the start of each game, and each moves along its own track as the points are accumulated by the respective players. These games are extremely popular at fairgrounds and pleasure parks, and create considerable excitement amongst the participants as during the course of play all of the respective horses advance in steps depending upon the performance of the players arranging for their playballs to drop through the appropriate holes in the play table.

This type of machine has in fact been well known for a large number of years, and strangely enough there have been virtually no variations in same since its first inception.

The present invention derives from the basic operation and construction of a machine of the type described above, and this basic variation comprises that instead of utilising a track and a movable component, each play table is provided with its own standard against which the player competes. Thus, in one example the player in fact plays against the clock, and there is a clock device associated with each table. In the typical arrangement, as the player rolls the ball into the respective holes on the table, so one of the hands of the clock steps forward one step for each point scored, and each step may in fact be a step of one minute on the clock face. At the same time, the other hand on the clock face may be arranged to move one step per second (countdown) so that in fact in sixty seconds the said hand will have counted down through 360° on the clock face. The player will be competing against a sweep of that hand by endeavouring to sweep the other hand as a result of play on the table through 360° before the timed hand and if he can succeed in defeating the timed hand, then he will have succeeded in winning a prize. The countdown hand may indicate a reducing level of prize with the passage of a predetermined period the prize reducing to zero at the end of that period. The quicker the player completes the sweep of the play hand before the countdown hand completes its countdown, the greater will be the players' prize.

If the countdown hand has not completed its countdown before the play hand reaches its goal the countdown hand stops, indicating the level of prize which has been won. If the countdown hand completes its countdown before the play hand reaches its goal, the player loses.

It can be seen that this concept is fundamentally different from the machine described above, because a table and associated standard setting device can be used by one individual without requiring any other players. It was a disadvantage of the known machine that it required a plurality of players in order to commence operation.

The machine of the present invention does not preclude the utilisation of a plurality of the tables and standards and linking same together so that a plurality of players can take part and compete against each other, in which case it would be a simple matter to isolate so as to render inoperative the timed countdown hands of the respective clocks, in which case the respective players would be competing against each other with the objective of reaching a sweep of 360° first, and to achieve this multiple person play, the various tables and clocks would be interlinked so that as soon as one person has achieved a sweep of 360° by the appropriate hand of his clock, then a bell or other signal would sound in order to indicate that the game had been won. The interlinked machines would be capable of reset so that each machine would be reset to an initial position following each game.

Therefore, at the commencement of the day's operations, the operator of the machine could if he wished set each of the machines for individual play so that individual players could play independently of other players, and if there were sufficient players then the operator could switch the play to the multiple participant arrangement described above in which the respective participants are competing against each other.

It is to be pointed out however, that market research suggests that the machine has better player appeal in a single unit at which a single player plays at any one time.

The broad concept of the invention it has become clear can be applied on a wider basis insofar as it is not necessary that the standard be in the form of an analogue clock as that described above. As an obvious alternative, the clock can be in digital form so that the participant could watch numbers instead of hands.

Also, in some embodiments instead of a clock being utilised, some other form of standard could be used. The standard may be in the form of a race displayed upon a TV monitor or indeed any other form of video display competitive game system could be used.

The skill part of the machine preferably will comprise the rolling of balls into holes or pockets, but it could take any other form or could involve the throwing of darts, the striking of balls, the utilisation of cues for propelling balls as long as there is some manual control over components such as balls which have free movement after being propelled as a result of direct manual effort or by manual effort through the use of a striking or propelling device.

The machines according to the invention will be provided with electrical and electromechanical controls to enable the play of the machine to take place in accordance with the required functioning. As the more desired form of the machine according to the invention is a single player unit, an indication of the play functions of such a unit are given.

In accordance with preferred constructions, the machine will be pre-programmed with various sounds to give indications of certain conditions of the machine. The so-called "sound programme" of the machine is given by way of example, and is capable of modification and variation as desired, but typically the sound programme may include sound indication for the insertion of a coin, sound indication for the commencement of the game, sound indication for indicating the player's score when he has achieved a win providing that generally speaking, the higher the player's score, the higher the tone of the sound signal to indicate a win, a sound indication when the player loses a game, a sound indication to indicate a jackpot win which means that the player has achieved the goal before the countdown device has reached a predetermined proportion of the total countdown period, and a sound signal for indicating a fault in the machine or mis-use of the machine. These various sound signals are programmed to operate automatically in sequence with the play of the machine.

As to the play of the machine itself, typically a single player machine will operate in the following fashion. The player inserts a coin into the machine and the coin receipt sound signal will emanate from the machine. A ball is discharged into a ball pick-up tray and the user can pick-up the ball and roll it along a bagatelle table when a "roll ball" light is illuminated on the machine. When the roll ball light is illuminated, the play hand and countdown hand are zeroed and in fact are positioned at the midnight position on the countdown clock face.

The countdown hand does not commence its countdown until the player has made his first score by causing the ball to fall through one of the score apertures. The player continues to roll the ball whilst the countdown hand steps around the clock face back to the midnight position. For each point scored by the player as a result of the ball dropping through a particular aperture, the play hand steps by particular angle, which may be as high as 30° so that in fact the player has to score 12 points to complete his play in any particular game and the object is to reach the 12 o'clock position before the countdown hand which, in such event will stop at the position to which it has moved indicating the level of prize won by the player.

The machine can be varied to vary the speed of countdown in order to vary the percentage success which can be expected of a large number of players who play the machine over a long period, to adjust the pay-out level of the machine.

The various sound signals emanate from the machine as appropriate. For example, when the game starts, there may be a ticking signal which is in synchronism with the countdown hand in order to increase the game excitement for the player. The win sound signal may for example be a short burst of a recognisable noise such as the playing of Westminster chimes for a short period i.e. of the order of three and a half seconds. If the jackpot is won, the playing of the chimes may take place for a longer period say seven seconds.

If there is a fault in the machine or if a player endeavours to mis-use the machine or to cheat by for example throwing two balls up the bagatelle table, then the machine will indicate a fault condition and will in fact block out the play balls preventing the player from further mis-using the machine. If such a mis-use is detected, the machine may be arranged to impose a penalty on the player by delaying return of the ball for a delay period for example of the order of five seconds.

At the end of the game, unless there are credits remaining in the machine resulting from the player inserting more than the required coin or coins for a single game, then the play ball will be locked in the machine until a release mechanism releases the ball for play at the start of the next game.

Further details concerning the control and operation of the machine are given in relation to the specific embodiment described hereinafter. The controls and operational functions of the machine in themselves form novel aspects of the present invention in providing means for giving effect to the play versus countdown function of the inventive machines.

An embodiment of the present invention will now be described, by way of example, with reference to the accompanying diagrammatic drawings, wherein:

FIG. 1 is a perspective view of part of a machine according to the present invention;

FIG. 2 is a front view of the clock face of one of the machines shown in FIG. 1;

FIG. 2A is a front view of a digital clock face displayed upon a TV monitor, which constitutes an alternative arrangement to the combination shown in FIG. 1 and in FIG. 2;

Figure 3:
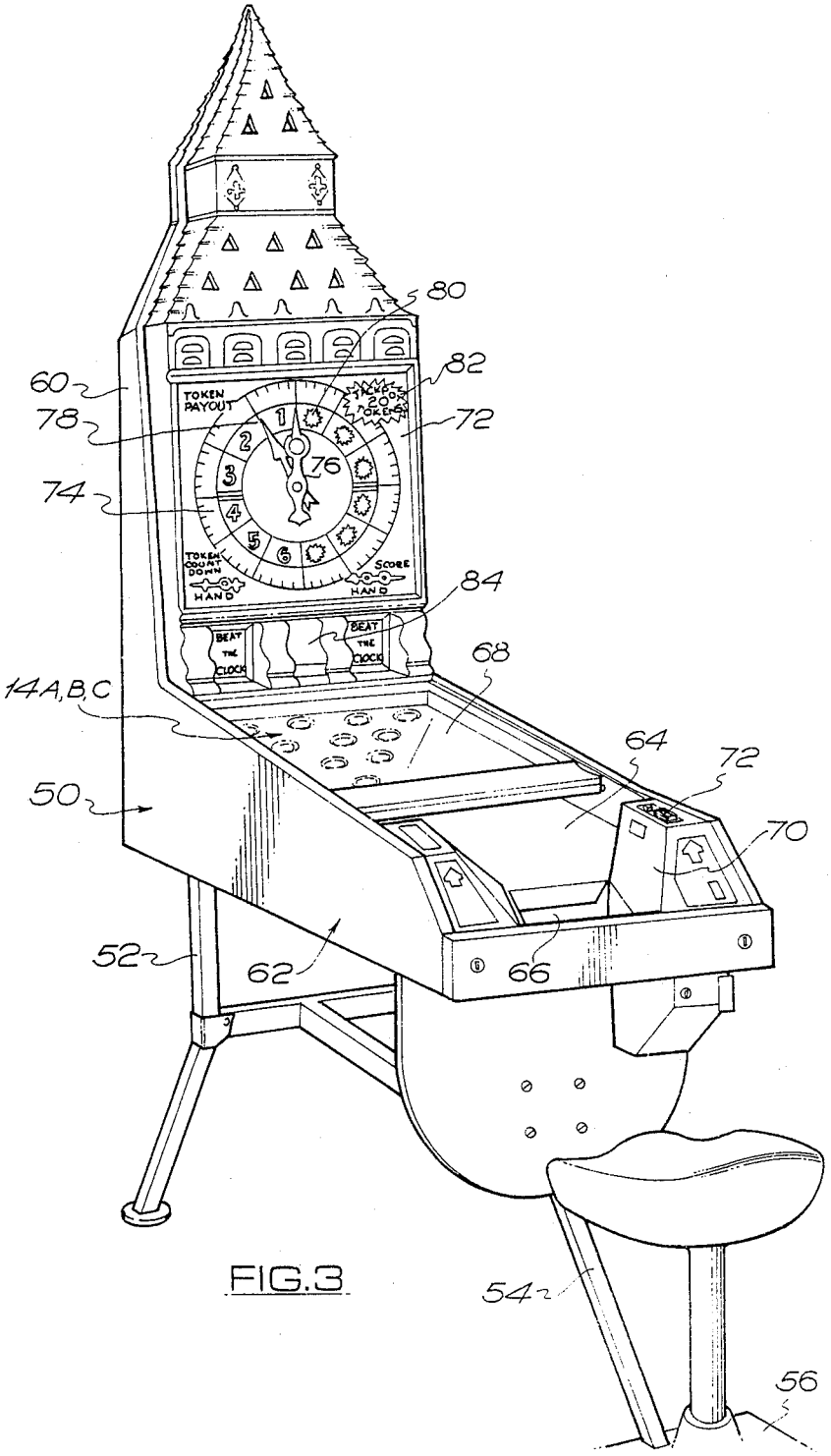
FIGS. 3, 4 and 5, show respectively a perspective view, a side view and plan of a machine according to a specific design and embodying the present invention.

Referring to the drawings, in FIG. 1 is shown a machine according to one embodiment of the invention. The machine comprises a plurality of play tables 10 which are in the form of inclined bagatelles in that the user sits on a stool or other support 12 at the lower end of the table and he is supplied with a ball. This ball he rolls up the table in an effort to cause the ball to drop through the holes 14A,B,C. Holes 14A,B,C are of the same diameter, and the ball is of a size so as to be capable of passing through each hole with only slight clearance. The holes 14A,B,C are designated so as to represent different numbers of "points" in the play of the game and thus holes 14A represent one point, holes 14B represent two points, and holes 14C represent three points. Therefore if a player causes the ball to fall through one of the holes 14A he is awarded one point in the fashion to be explained, whilst if the ball falls through hole 14B two points are awarded, and finally if the ball falls through hole 14C, three points are awarded. Each time the ball falls through a hole 14A, B or C, it is returned to the front of the table through an aperture 16 and is caught in cup 18 from which it can be removed and once again rolled to the top of the table. In play using the machine, the object to be achieved by the player is to propel the ball up the table and through the holes as frequently as possible so as to accumulate points as quickly as possible.

Underneath the table is a suitable mechanism to detect which hole the ball has passed through, in order to record the number of points to be awarded each time the ball passes through a hole. Such means for sensing and recording and control is electronic and/or electromechanical and particulars thereof are supplied hereinafter. The cable 20 which is shown as extending from the underside of the table 10 to a rear cabinet 22 provides a means for transmitting signals representative of the points scored at each time the ball drops through a hole 14, and the cabinet 22 as shown is provided on the front face thereof with a clock dial 24 (which may for decorative purposes represent Big Ben) and the clock dial is analogue in nature and is provided with two hands 26 and 28. In this example the hand 26 is the "timing" or "countdown" hand, and hand 28 is the "points" or "play" hand.

Because the machine of FIG. 1 has the capability of being used with other similar machines in ganged fashion, there is a corridor 30 between the tables 10 and the cabinets 22 to enable an operator to walk therebetween, and to this end platform 32 on which the operator may walk is provided as shown.

In the play of the machine described, in one mode of operation, the timing hand 26 at the commencement of play starts from the 12 o'clock position shown and then steps round at one second intervals through one revolution of the hand 26 until the hand returns to the 12 o'clock position. This period of one minute represents the game play time, and the object of this mode of operation is for the player to "beat the clock" in that each time the ball falls through a hole 14A, 14B or 14C, the hand 28 makes the appropriate step or appropriate number of steps corresponding to the point or points scored. Thus, if the player could propel the ball into a hole 14C at each throw, then the hand 28 would step by an angle representing the three points which may be three seconds, or could be fifteen seconds.

If the player achieves that the hand 28, which also starts at the 12 o'clock position, completes one revolution before the timing hand 26, then he wins a prize. If it is found that the stepping of the hand 28 by a one second interval for each point is insufficient, the control mechanism can be adjusted so that for example the hand 28 steps by twice or three, four or five times a one-second angular interval for each point scored on the play at the table 10.

If a player wins against the machine insofar as if he achieves that the hand 28 sweeps to the 12 o'clock position before the countdown hand 26 has reached such position, the countdown hand stops and depending upon the angular extent which it has travelled from the commencement of play, so the greater will be the prize awarded to the player. If reference is made to FIG. 2 it will be seen that in the five second intervals between the 12 o'clock position and the 6 o'clock position, each interval is designated by the number 20, whereas for the six five minute intervals between 6 o'clock and 12 o'clock the intervals are represented by the numbers 6, 5, 4, 3, 2, 1. These numbers represent the prize value which will be won by a player if the countdown hand 26 is stopped by the play hand 28 reaching the 12 o'clock position. If the countdown hand stops between the midnight and 6 o'clock positions, then a prize to the value 20, for example 20 tokens, will be won, and the player is considered to have won the jackpot. If the countdown hand 26 stops between the 6 o'clock position and the midnight position, then the prize level will be anything from 6 down to 1 depending upon where the countdown hand stops. In practise the numbers indicated in FIG. 2 indicate tokens, but they could indicate coins where the machine has a coin pay-out arrangement.

In a modified embodiment of the invention, a plurality of the machines described are arranged side by side as shown partly in FIG. 1 so that a plurality of players may sit at the individual machines. The machines may furthermore be ganged by appropriate adjustment by switching of the control means so that in fact the players are competing against each other and in which case the time hands 26 may be immobilised. In the play of such a game, the person who first completes one revolution of the points hand 28 by his skill in propelling the ball through the holes 14A, 14B and 14C, will be the winner, and the control circuit may also provide a means for indicating when a game has been won, and by which player.

The game has particular advantage over the known Derby game described herein in that a player can watch the sweep of the hand of the clock or movement or change in other countdown means in his attempt to reach a winning position, which in itself generates excitement. Additionally, because the individual machines can be arranged so that individual plays can take place, the operator does not require every seat 12 to be filled before he can commence play of the machine.

Extending the embodiment of the invention described, it will be understood that as shown in FIG. 2A, instead of providing an analogue clock face, a TV monitor may be used to display the time digitally. In FIG. 2A, one field 34 illustrates the running time against which the player has to compete, whilst field 36 shows the player's point score or time. In the example illustrated in FIG. 2A, the game is 37 seconds old, whilst the player managed to achieve a score representing 47 seconds in the same period and therefore he is ahead of the clock. If the figure 1.00 is achieved in field 36 before field 34, then the player wins whereas if the machine reaches the reading of 1.00 in field 34 before it is reached in the field 36, the machine wins.

Figure 4:
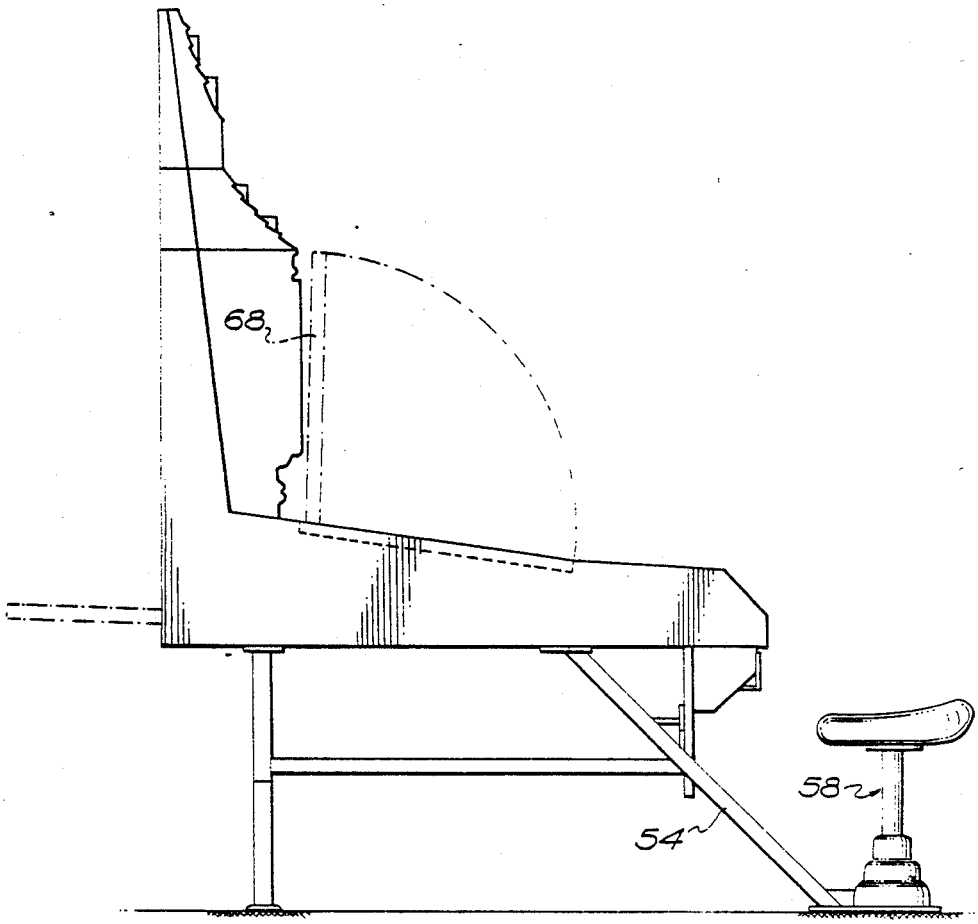
Figure 5:
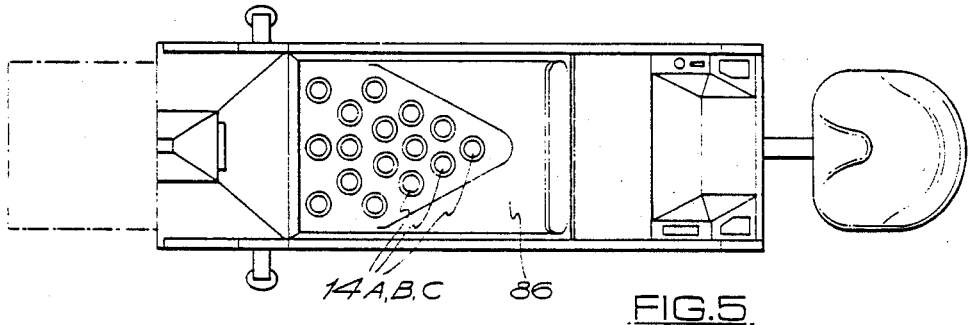

The machine shown in FIG. 1 is somewhat diagrammatic, and FIGS. 3 to 5 show the appearance of a practical machine. Referring to FIGS. 3 to 5, the machine shown comprises a casing 50 which is supported by legs 52 and 54, being rear legs and a single front leg. The rear legs 52 are adjustable in height in order to vary the front to rear inclination of the casing 50. The front leg 54 is attached to a base plate 56 which rests on the floor, and the base plate also supports a player seat 58 of the construction shown.

The casing 50 essentially comprises an upright back portion 60 and a table portion 62 which extends generally at right angles to the upright back portion 60 so as to be substantially horizontal, although as will be clear from the following, it is important that the table surface 64 on which the ball is rolled during the play of the game should be sloping from back to front in a downwards direction.

The front portion 62 has at the front thereof a ball pick-up tray 66 from which the play ball can be removed by hand, and the play table 64 is partially covered by protective screen 68 of transparent material, which as shown in FIG. 4 can be pivoted upwardly in order that the play surface 64 can be cleaned.

To the rear end of the play surface 64 are the ball apertures 14A, B, C having the same function as the apertures 14A, B and C as described in relation to FIG. 1.

To the right hand side of the pick-up tray 66 is a coin receiving mechanism 70 with a coin slot 72 for receiving coins to initiate play of the game.

The rear of the casing 60 is shaped on the front face thereof as indicated so as to simulate a clock tower (in particular Big Ben clock tower), and in a panel 72 is a clock face 74 provided with the hands 76 and 78 which correspond to the hands 26 and 28 already described in relation to FIG. 1. It will be noticed that in the arrangement of FIGS. 3, 4 and 5, the walkway 30 is omitted, as the machine is a single player machine. Play of the game using the machine illustrated in FIGS. 3, 4 and 5 is identical to that already described in relation to FIG. 1, but the clock face 74 has star indications 80 in the six five minute intervals between 12 o'clock and 6 o'clock, and a display location 82 on the face 72 indicates that if the countdown hand 26 stops in any location between 12 o'clock and 6 o'clock, then the jackpot of 20 tokens is paid out. A token pay-out chute is located centrally of the rear 60 at the front of the rear portion of the machine and where it meets the front portion 62. The pay-out chute is indicated by reference 84.

As illustrated in FIG. 5, the various apertures 14A, B and C are located behind a simple ball return aperture 86. The ball falls through aperture 86 if it does not pass through an aperture 14A–14C and it is returned to the pick-up tray 66 as long as the game is in play, but no points are scored.

Reference is now had to the drawings FIG. 6 to FIG. 15 for the description of the control system of the machine, specifically the machine shown in FIG. 3, but the same control system can be adopted for the machine shown in FIG. 1, and also other machines constructed in accordance with the principles of the present invention.

Figure 6:
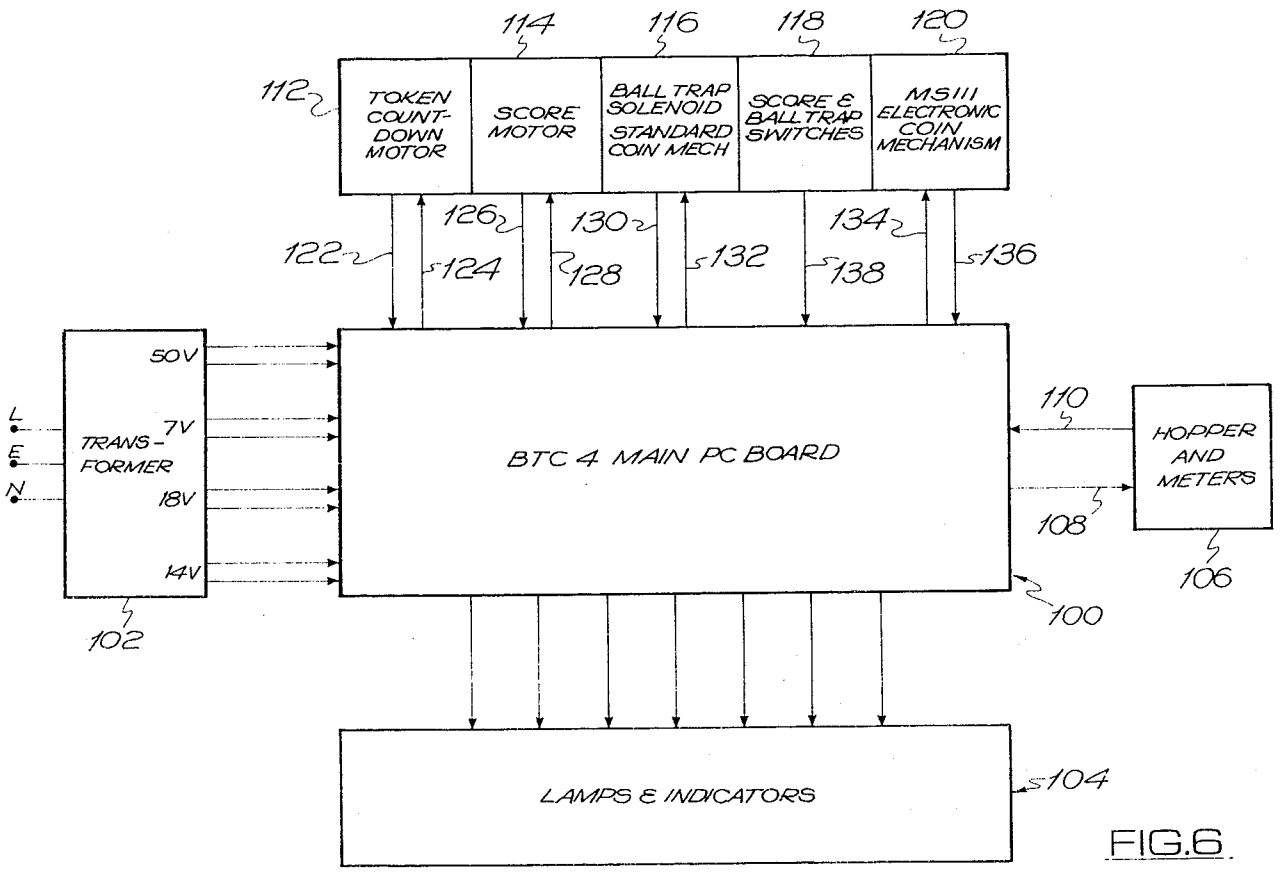
FIG. 6 is a block diagram representing the control system of the machine of FIG. 5.

Referring now to FIGS. 6 to 15 which show circuit diagrams of the control system of the machine illustrated in FIGS. 3, 4 and 5, referring to FIG. 6, the block diagram shows that the control circuit is provided with a printer circuit board 100 which is supplied with various voltage supplies via a transformer 102, and the printed circuit board 100 drives a series of lamps and indicators 104 as referred to generally hereinbefore, and described hereinafter in greater detail. Additionally, the board 100 drives a hopper and meter circuit 106 via supply and return lines 108, 110 because certain feedback is required from the hopper and meter circuit 106.

Similarly, the board 100 is connected to a token count down motor 112, a score motor 114, a ball trap solenoid and standard coin mechanism 116, a score and ball trap switches circuit 118, and an electronic coin insertion mechanism 120. Circuits 112, 114, 116 and 120 are coupled to the circuit board by supplying return lines 122, 124, 126, 128, 130, 132, 134 and 136 for the supply and return of signals to and from the respective circuits. Circuit 118 has a return supply signal line 138 only.

Figure 7:
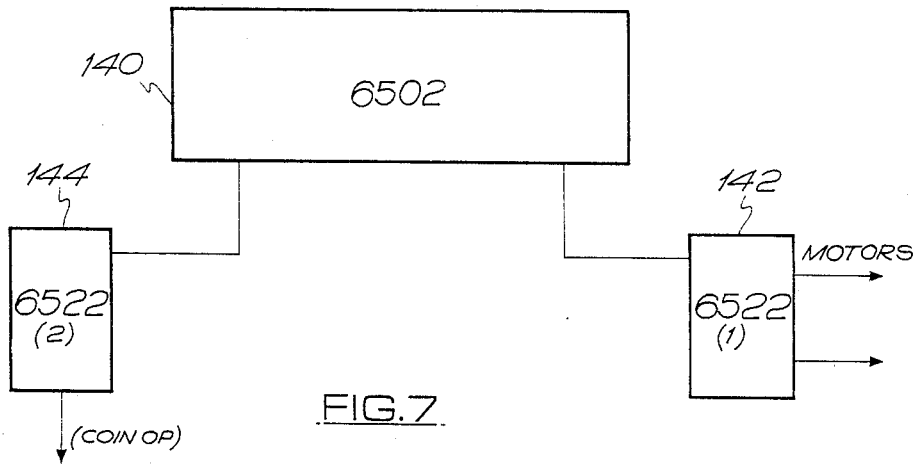
FIG. 7 is a block diagram of a portion of the control system of FIG. 6.

As shown in FIG. 7, the circuit board 100 comprises a main processor unit 140 which is connected to similar adaptors 142 and 144 which are known as versatile interface adaptors.

Figure 9:
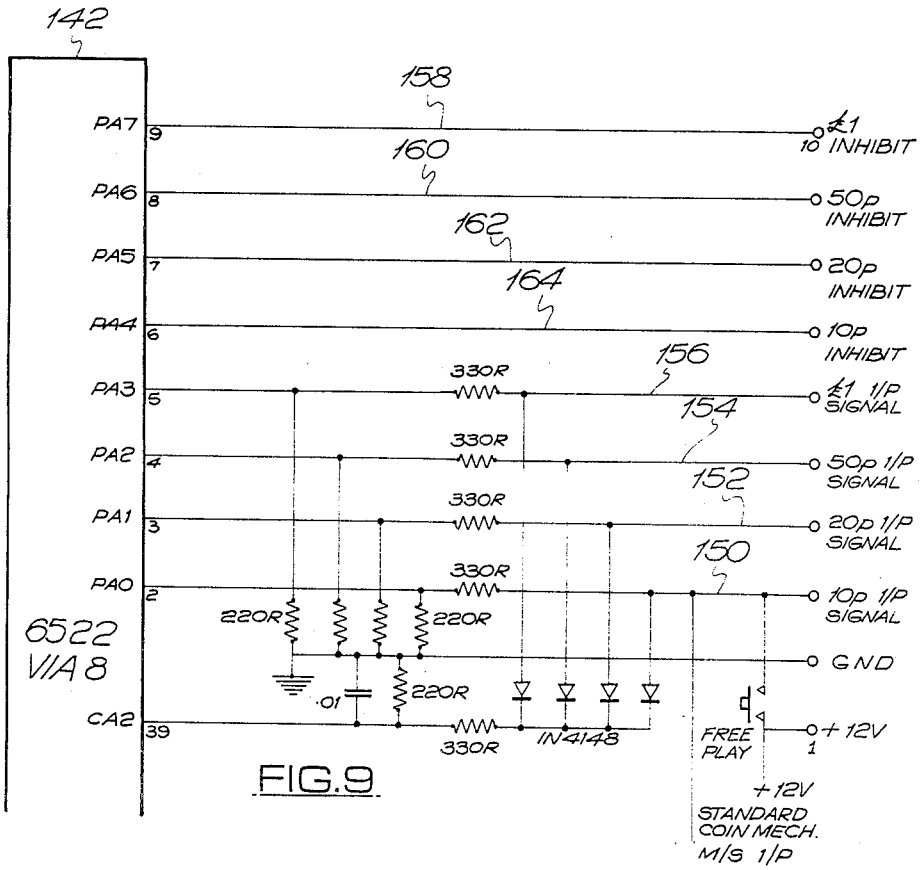
FIG. 9 is a circuit diagram of the coin mechanism input logic of the control system of FIG. 6.
Figure 8:
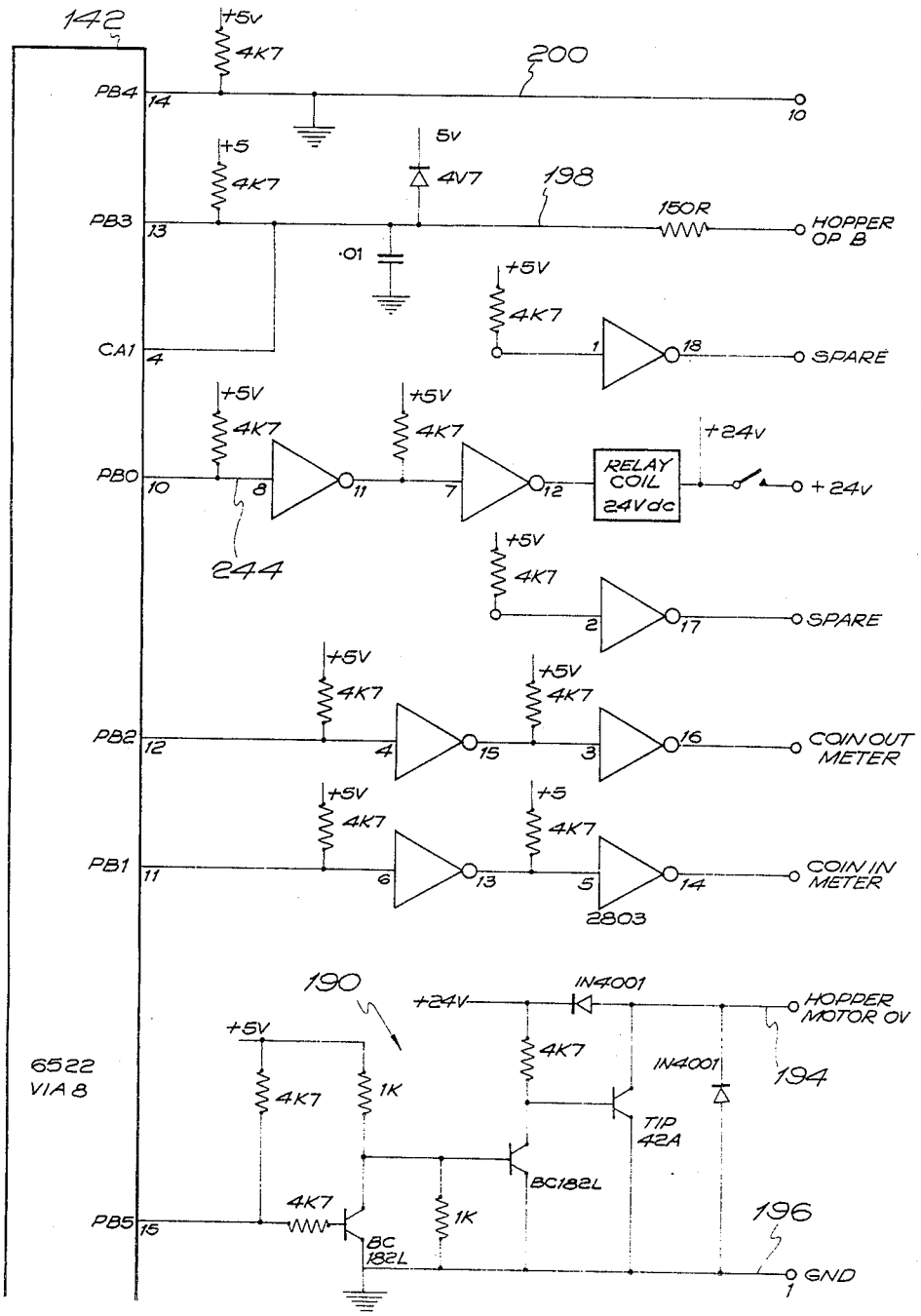
FIG. 8 is a circuit diagram of the meters and hoppers logic of the control system of FIG. 6.
Figure 10:
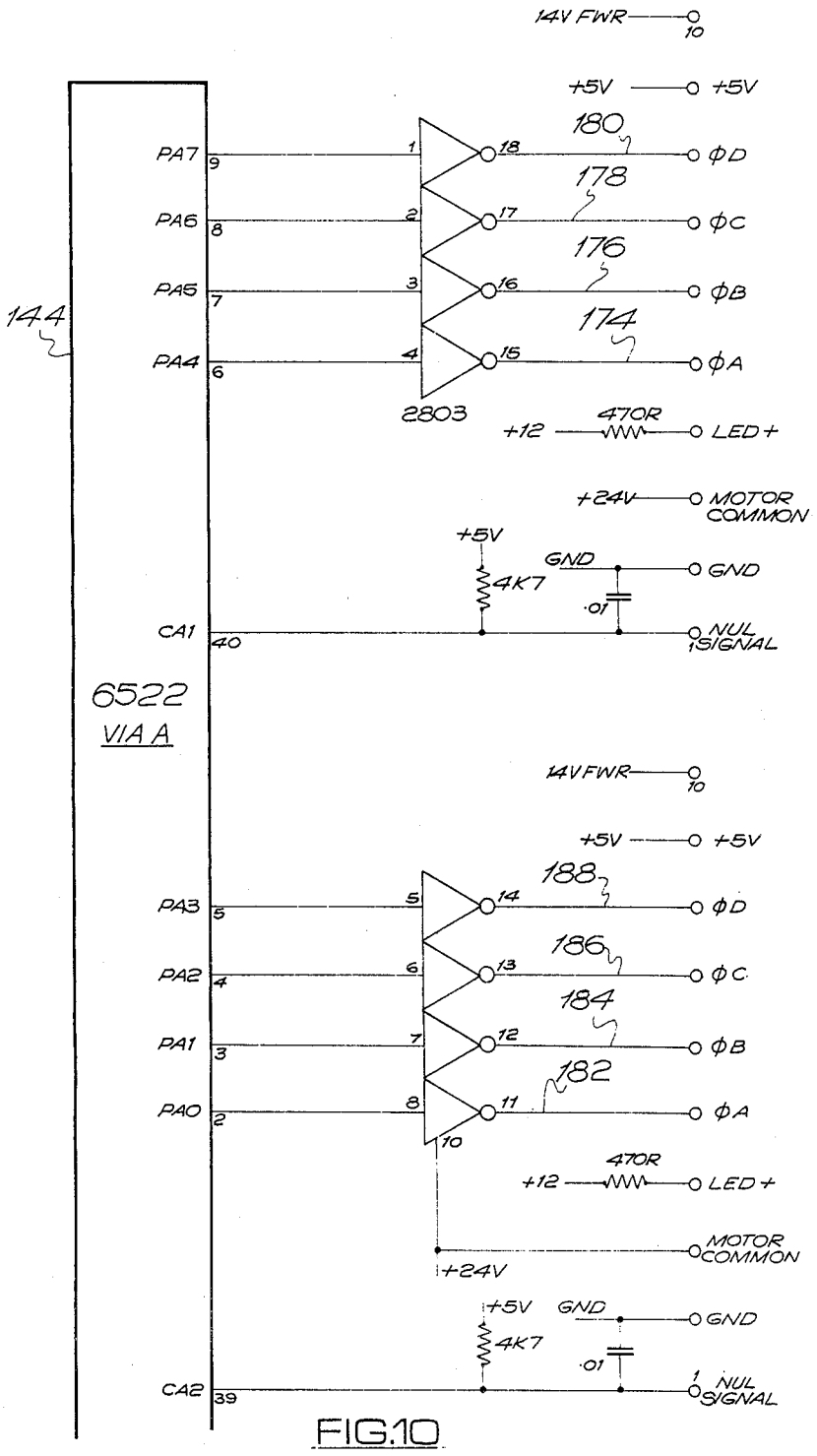
FIG. 10 is a circuit diagram of the time/score finger drivers of the control system of FIG. 6.
Figure 11:
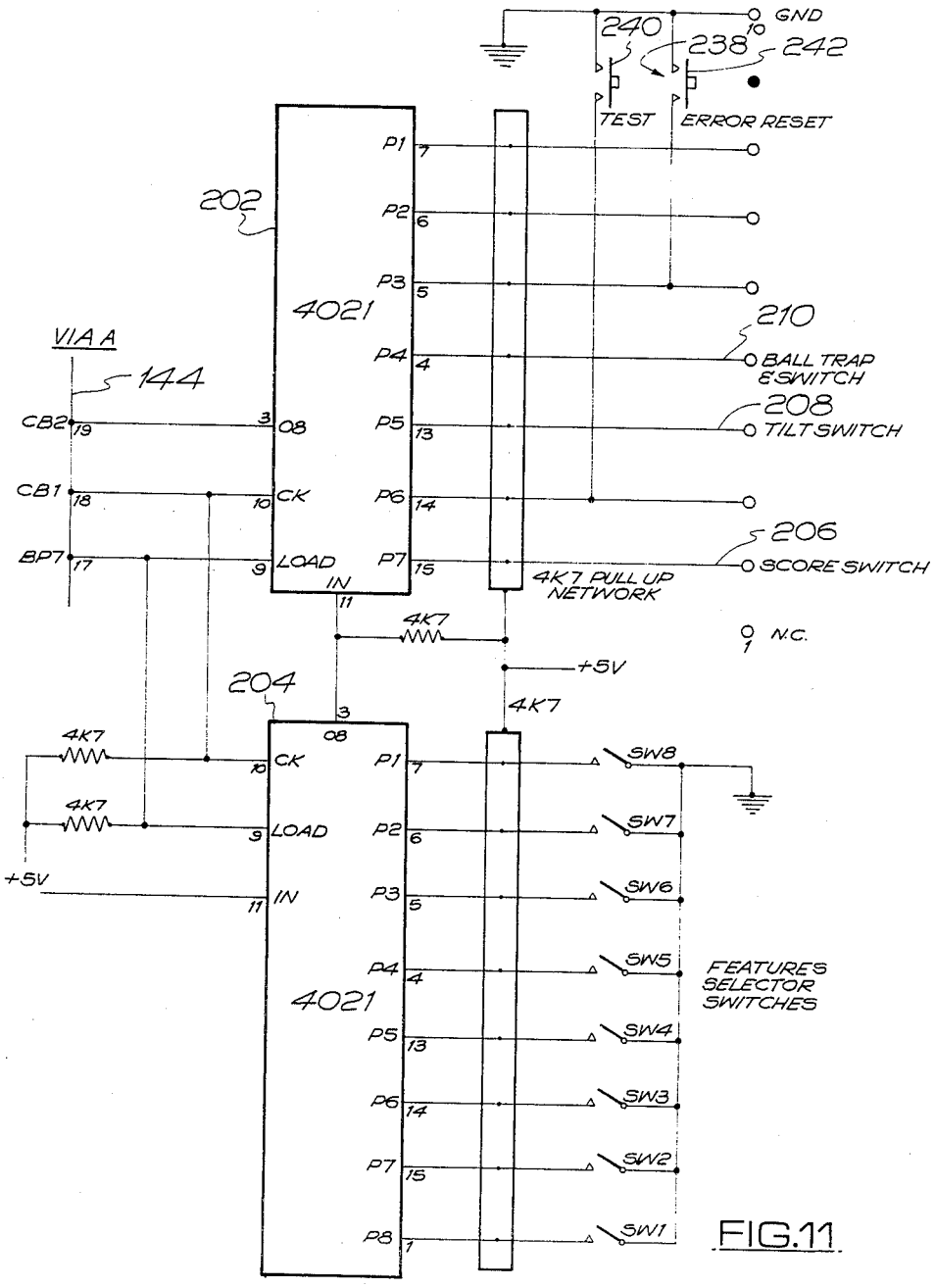
FIG. 11 is a circuit diagram of the switches input logic of the control system of FIG. 6.
Figure 14:
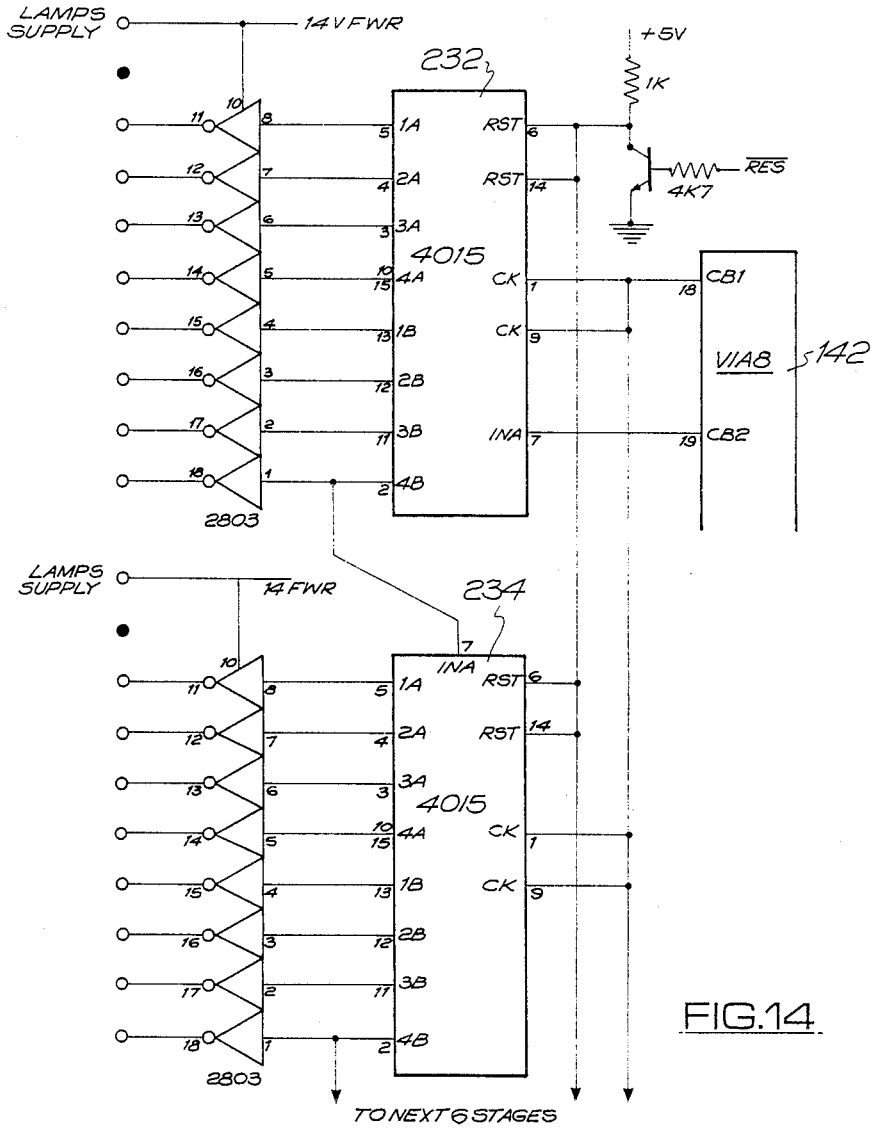
FIG. 14 is a circuit diagram of the lamp drivers of the control system of FIG. 6.
Figure 15:
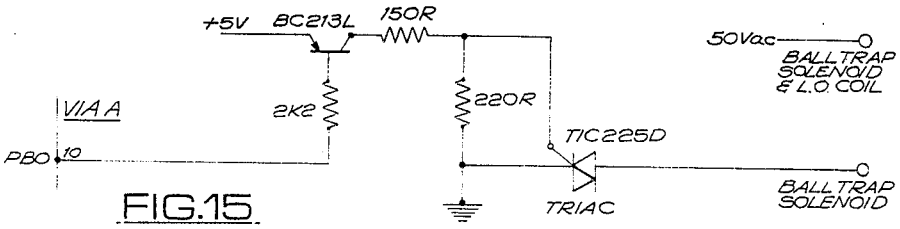
FIG. 15 is a circuit diagram of the ball trap driver of the control system of FIG. 6.

The processor and adaptor numbers are indicated in the drawings, and adaptor 142 is also indicated in FIGS. 8, 9 and 14 by the description via A, whilst adaptor 144 is illustrated in FIGS. 10, 11 and 15 by the description via A.

Figure 12:
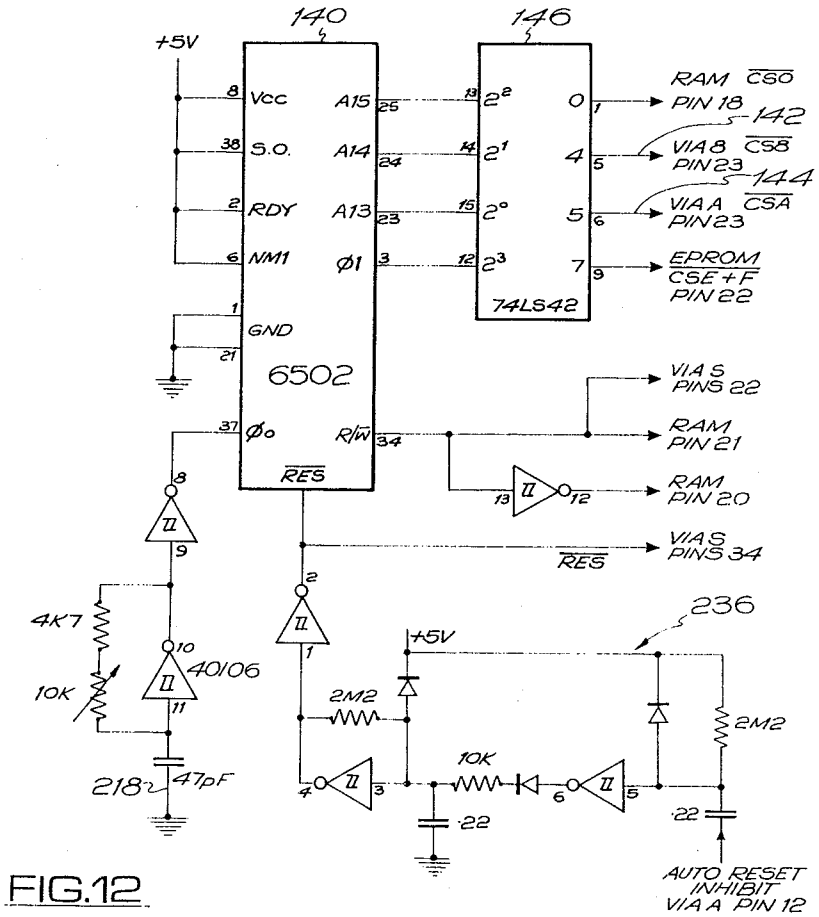
FIG. 12 is a circuit diagram indicating the processor and clock pulse and reset circuits of the control system of FIG. 6.

FIG. 12 shows that certain outputs of the processor 140 are fed to an address decoder 146 some of whose outputs are directed to the variable interface adaptors 142, 144.

Referring in more detail to FIG. 9, the terminals PA0, PA1, PA2 and PA3 are connected to the electronic coin detection mechanism which signals on one of these inputs depending upon the coin which is inserted. Line 150 represents the 10p input signal, line 152 represents the 20p input signal, line 154 represents the 50p input signal and line 156 represents the 1 input signal. It is assumed that each game on the machine costs 10p. The signals from these lines indicate to the adaptor the value of the coins inserted, and via other circuits the machine indicates the total amount of credit in the machine, and also initiates operation of the sound system to indicate that one or more coins has or have been received in the machine. The processor through the adaptor 142 creates an inhibit signal on lines PA4, PA5, PA6 and PA7 which prevents the insertion of any further 10p, 20p, 50p or 1 coin when a game is in play. The inhibit signals on these terminals of adaptor 142 apply inhibit outputs on lines 158, 160, 162 and 164 inhibiting in the electronic coin mechanism 120 the further insertion of coins during play.

Referring now to FIG. 15, when coins are inserted indicating that a game can be played, the ball trap solenoid embodied in the machine is enabled from the adaptor 144 through the circuit 166 comprising an amplifier 168 and a triac 170 providing an output on the ball trap solenoid enabling line 172, so that the ball is released to the player as described hereinbefore. At the same time there may be a sound indication to the effect that the ball has been released.

The player now rolls the ball as described hereinbefore, and when the ball falls through one of the apertures 14A, 14B, 14C on the table surface, this is detected by a score unit and a countdown unit which respectively are illustrated in FIG. 10. The countdown unit is connected to terminals PA4, PA5, PA6 and PA7 of the adaptor 144, whilst the scoring circuit is connected to terminals PA0, PA1, PA2 and PA3. As soon as the detection of the ball passing through one of the apertures is achieved by means of the operation of a score switch, operated by the ball, a signal is received via one of the terminals PA0, PA1, PA2 or PA3. The circuit connected to terminals PA4, PA5, PA6 and PA7 is rendered operative and in fact only one of the output lines 174, 176, 178 and 180 is enabled, depending upon the rate of movement required of the countdown hand 78 in FIG. 3, and that hand commences its countdown as explained hereinbefore. The commencement of the countdown may also commence operation of the sound signal representing countdown as explained hereinbefore.

The number of steps executed by the score hand, whose driving is effected by means of a stepping motor, are recorded via the lines 182, 184, 186 and 188 as shown in FIG. 10, and in fact the signals countdown from a preset value corresponding to the zeroed position of the countdown hand and score hand. When either the stepping motor which drives the countdown hand or the stepping motor which drives the score hand reaches zero, the other motor is automatically inhibited so that the other hand will immediately stop. It should be mentioned that when the coins are inserted, for the commencement of play of a game, the two hands countdown and score are automatically zeroed. Depending upon whether or not the score hand has reached the zero position before the countdown hand or vice versa so an appropriate coin or token payout is effected by the machine as described hereinbefore. FIG. 8 illustrates the circuitry for the meter and hopper logic.

The circuits on terminals PB1 and PB2 of adaptor 142 serve to count the total number of coins inserted in the machine and respectively the total number of coins or tokens paid out.

FIG. 8 also shows via circuit 190 a hopper motor driver circuit which is enabled when a player wins a game as described hereinbefore. Via terminal PB5 and line 192 the hopper motor is driven via the amplification circuit 190, the hopper motor being connected between terminals 194 and 196.

On terminals PB3 and PB4 the hopper count circuit is connected via lines 198 and 200, the hopper count mechanism counting the number of tokens or coins paid out by the machine.

In FIG. 11 the switches input logic is illustrated, and it will be seen that this includes two switch registers 202 and 204 connected in series, and switch register 202 is connected to the adaptor 144. Line 206 represents the input from the ball score switches which in turn drives the score stepping motor through the lines 182, 184, 186 and 188 as shown in FIG. 10. The score switch circuit is operated from three switches located in channels along which the ball passes in travelling under the machine table after it has passed through a hole. If it passes through a hole 14C, then it rolls over each of the three switches in turn. If it passes through hole 14B, it rolls over two switches in turn, and if it passes through hole 14A it passes over only one switch hence the provision of the different score signals. The shift register 202 by virtue of the clock input CP1 constantly samples the signals on terminals P1–P7 which include a tilt switch signal on line 208, and a ball trap signal 210. If the tilt switch signal shows that the machine has been tilted, then the machine automatically is stopped, and a fault indication is displayed.

The ball trap solenoid circuit is indicated in FIG. 15 by reference 212 and the solenoid which traps the ball is operated at the appropriate time at the end of a game provided that there is no credit remaining in the machine. It is necessary therefore for the shift register 202 constantly to monitor the condition of the ball trap switch. At the end of each game, the countdown and score hands are automatically zeroed via their drive circuits as shown in FIG. 10, and as soon as a score is received on score switch line 206, the next game is started.

When there is a win in a game, depending upon the level of the win, the sound circuits are operated to indicate the win in the manner as hereinbefore described. The level of the win can be detected by comparing the degree to which the countdown motor has stepped from the initial position.

Figure 13:
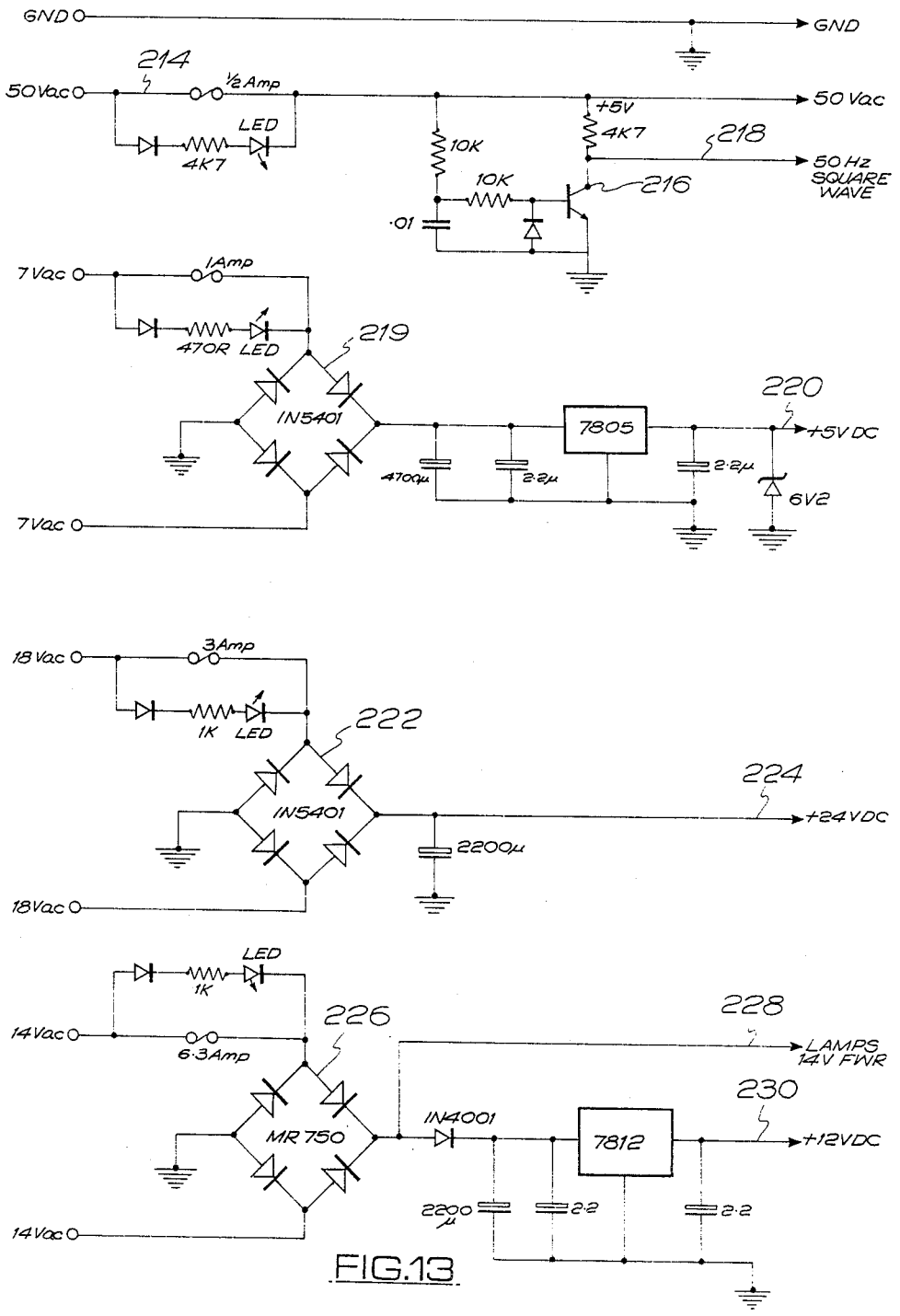
FIG. 13 is a circuit diagram showing the power supplies for the control circuit of FIG. 6.

FIG. 13 shows the power supplies provided for the circuit described. The transformer 102 provides 50 volts AC, 7 volts AC, 18 volts AC and 14 volts AC. The 50 volts AC supply line 214 provides direct 50 volts AC for the solenoids, whilst the circuit 216 provides a 50 Hz square wave block pulse on line 218.

The 7 volt AC supply provides through a rectifier 218 and smoothing circuits, a 5 volts DC supply 220 for the logic circuits.

The 18 volts AC through a rectifier 222 provides 24 volts DC supply for the stepper motors and hoppers as indicated by reference 224, whilst the 14 volt supply provides through a rectifier 226 14 volts DC for the lamps on line 228, and 12 volts DC supply for the coin payout mechanisms on line 230.

FIG. 14 illustrates the connection of a shift register 232 to the adaptor 142 and the shift register outputs 1A–4A and 1B–4B provides output lines for the game lamps which are "game over" lamps whilst the second shift register 234 connected in series with shift register 232 provides the output for clock lamps and decorative lamps on output terminals 1A–4A and 1B–4B of the shift register 234.

FIG. 12 shows that the processor 140 is connected to the clock supply circuit 218 for the driving of the processor, and a further circuit 236 is provided for enabling reset of the processor if the processor performs what is known as "looping" and requires to be reset to enable it to control the operation of the control system.

In FIG. 11 is shown as connected to the shift register 204 a bank of switches coupled to terminals P1–P8 of shift register 204. These switches can be used for optional additional features of operation of the machine. For example when the machine is in play, and the player loses, the ball may well and probably will be returned to the ball collection cup 66 in FIG. 3. A player who has lost may well be inclined to steal the ball. However by closing the switch number one connected to P8 of shift register 204, for example, the machine may be arranged such that if the player returns the ball he will receive payment of one token. By the selective closing of the switches connected to terminals P1–P8, so additional optional features can be embodied into the play of the machine.

Also shown in FIG. 11 by reference 238 is a test and error reset circuit comprising two switches 240 and 242. The depression of switch 240, which may be accessible only to the machine operator effects test of the operation of the machine. Equally, the switch 242 may be depressed for resetting an error in the machine.

Additionally, in FIG. 8, the circuit 244 connected to terminal PB0 is a hopper cut-off circuit in the event that the machine detects an error or a fault. For example if a player endeavours to use two balls simultaneously the circuit 244 is enabled and detects an error and therefore terminates any payout.

The various lamp drivers shown in FIG. 14 may drive for example "insert coin" lamps, "roll the ball" lamps for prompt purposes, and may also drive a seven segment display lamp which indicates the total number of credits in the machine. Typically, the maximum amount of money which can be placed in the machine at any one time is 1 and the seven segment display will therefore indicate the numeral 9, indicating that there are an additional nine games to be played as well as the initial game.

The described circuit effectively controls the operation of the machine to achieve the functions as hereinbefore described.

The machine is equipped in its control system, to prevent cheating, by a player using two balls, as indicated herein. If the use of two balls is detected, a two ball error indication light is illuminated and the player is penalised. The two ball error light is cancelled at the end of the game.

The error indication and an alarm lets the player know that he has been "caught out". Cancelling the error at the end of the game ensures that the machine is not unnecessarily left in an "out of order" condition.

The control system therefore attempts to disadvantage a player who uses two balls by inhibiting scoring and by indicating an error by displaying the letter F on the 7 segment display and by sounding an alarm.

This is achieved in that the ball runs over the ball trap micro-switch, scoring is inhibited for a predetermined number of seconds. If the score micro-switch is operated during this time the two ball error comes on but the score finger on the clock does not move. It is quite possible for a player using two balls to score only once and none of his subsequent scores to be registered.

If he attempts to defeat the timing by rolling two balls simultaneously, the program will only allow 3 points to be scored between operations of the ball trap micro-switch. If more than 3 points are scored then the two ball error comes on. This should also defeat anyone trying to cheat by using a stick or rod up the table to operate the micro-switches.

The ball trap comprises a solenoid as mentioned herein and a ball trap micro-switch. The solenoid controls a gate and opens same when the solenoid is energised to all the balls to roll into the ball tray 66.

The ball trap solenoid is energised whenever the player is in credit or a game is in progress.

At the end of a game, the ball is not trapped if the player still has credit for another game—payouts occur immediately.

At the end of a game, if the player wins and has no credit left—then the ball is not trapped until the ball trap micro-switch operates.

The roll the ball lamp flashes until the ball operates the trap micro-switch. If the ball is not returned within 10 seconds, the ball missing error is indicated and the alarm sounds. If feature switch 1 is on as described herein, no payout occurs until the ball is returned. The ball missing error is cleared as soon as the ball is returned.

At any other time, the missing ball error comes on if the ball is not in the trap.

The control system is equipped to detect other errors, as follows:

| | |
|---|---|
| E | Hopper Empty |
| P | Hopper Overpaying |
| c | Coin Mech M/S stuck |
| C | Excess Credit Registered |
| O | Ball Missing |
| t | Tilt |

and when any such error occurs, the indicator flashes and the alarm sounds. Coin mechanisms are inhibited and lock-out coils drop.

Hopper overpaying, excess credit and hopper empty errors can only be cleared by pressing reset button 242. Other errors clear when fault is cleared.

Tilt

Tilt error and tilt lamps flash whilst tilt switch to line 208 is operated and for 5 seconds after it is released. No score can be made during this time. Tilt error automatically clears 5 seconds after tilt switch returns to normal.

Excess Credit Error

Occurs if a credit in excess of 11 is registered. Credit is automatically reduced to 1.

As mentioned herein the feature switches connected to shift register 204 terminals P1–P8 can be selected for special feature operation, and further details are now given of examples of such features:

| | |
|---|---|
| SW1 ON | Payout of one token for return of ball |
| SW3, SW4 | Selects number of points required to Win - 17, 18, 19 or 20. |

| | SW3 | SW4 |
|---|---|---|
| 17 points | ON | ON |
| 18 points | ON | OFF |
| 19 points | OFF | ON |
| 20 points | OFF | OFF |

Amount paid out depends on which sector the time clock finger is in when the player wins. In general, the greater the margin by which the player beats the clock, the more tokens he wins.

Provision is made in the control system for any number of sectors (up to 16) and for any payout for any sector.

As the score hand and countdown hand motors are 200 step types, each sector must be an integral number of 1/200 parts of a circle (1.8°).

Any sector can be any number of 1/200 parts of a circle wide.

Test

The Test switch 240 is not effective if:
There is credit on
A game in progress
An error indicated
Payout in progress
Otherwise, when test switch 240 is pressed:
Lock-out coil energises
Inhibits removed from coin mechanism
Power removed from motor
Tilt, game over, win, table and roll ball lamps all light Clock lamps go out. Clock lamps are used as test indicators for:

Table micro-switch
Tilt switch
Ball trap switch
Test switch
Reset switch
Coin mech 10p O/P
Coin mech 20p O/P
Coin mech 50p O/P
Coin mech f1 O/P
Hopper O/P B
Run hopper by pressing reset switch 242.

The seven segment light emitting diode display is a processor clock frequency indicator. Showing 1 (on 50 Hz supplies) or E (on 60 Hz supplies) when the clock frequency is correct.

The test is terminated by pressing the test switch 240 again—the processor is forced into a loop and the auto-reset circuit 236 operates.

NOTE—Consider when revising specification in FIG. 8 the circuit indicated by lines 198 and 200 relates to the coin delivery detection system. A photo-electric output on line 198 counts the number of coins being dispensed when a win is achieved, the coins being dispensed as a result of energising the hopper motor supplied through lines 194 and 196. When the correct number of coins has been counted as a result of the signals on line 198, the supply to the hopper motor on lines 194, 196 is terminated.

The machine according to the invention provides the combination of a player's skill in moving a component which travels freely either against the skill of other players and/or against a pre-set programme as contained in the machine.

We claim:

1. A gaming machine, the play of which involves the skill of the player in propelling or dropping a component which thereafter moves freely with the object of arriving at a predetermined location or one of a plurality of predetermined locations, which gives an indication of the player's performance, comprising in combination:

(a) a component,
(b) means for defining said location or locations,
(c) means for detecting the arrival of said component at said location or one of said locations,
(d) means for totaling the player's performance based upon each arrival of the component at said location or one of said locations and displaying a player score representative of said player performance,
(e) machine starting means for starting the play of said game,
(f) standard setting means comprising an accumulating means for displaying said game elapsed play time against which the players performance is measured and which begins accumulating immediately after starting operation of the machine, and
(g) indication means for indicating when either the accumulating means or the totaling means reaches a predetermined final level, the improvement which comprises that said standard setting means is a clock face and said accumulating means comprises a first hand which moves in time around the clock face upon starting of the machine, and said totaling means comprises a second clock hand which sweeps around said clock face at a speed determined by the players performance.

2. A machine according to claim 1 wherein said component is a ball and the machine includes a table over which the ball is propelled by the player, said table having a plurality of apertures defining said locations and through each of which the ball can fall to indicate arrival of the ball at such location, some of said locations representing a higher level of player performance and others of said locations representing a lower level of player performance, whereby said second clock hand representative of said player score moves a greater distance around said clock face when the ball falls through one of said locations representing said higher level, and said second clock hand moves a lesser distance around said clock face when the ball falls through one of said locations representing said lower level.

3. A machine according to claim 2 wherein said table has a front end and a rear end, the rear end being higher than the front end and the rear end having said apertures so that if the ball does not fall through an aperture, it will roll back down the table surface to the front of the table, and wherein there is a collecting tray under the table to collect the ball when it falls through an aperture and to return it to the front of the table for re-use.

4. A gaming machine, the play of which involves the skill of the player in propelling or dropping a component which moves freely after being propelled or dropped with the object of arriving at a predetermined location or one of a plurality of predetermined locations, which gives an indication of the player's performance, comprising in combination, (a) a component,
(b) means for defining said location or locations,
(c) means for detecting the arrival of said component at said location or one of said locations,
(d) means for totaling the players performance based upon each arrival of the component at said location or one of said locations and displaying a player score representative of said player performance has been inserted after "locations",
(e) machine starting means for starting the play of said game,
(f) standard setting means comprising an accumulating means for displaying said game elapsed play time against which the player's performance is measured and which begins accumulating immediately after starting operation of the machine, and
(g) indication means for indicating when either the accumulating means or the totaling means reaches a predetermined final level, the improvement which comprises that said standard setting means is a digital clock which increments in seconds, up to a pre-determined number of seconds and said totaling means comprises a digital display which is located adjacent the digital clock and which increases in number up to said predetermined number at a rate determined by the player's performance.

5. A machine according to claim 4 wherein said component is a ball and the machine includes a table over which the ball is propelled by the player, said table having a plurality of apertures defining said locations and through each of which the ball can fall to indicate arrival of the ball at such location, some of said locations representing a higher level of player performance and others of said locations representing a lower level of player performance, whereby said digital display representative of said player score increments by a greater number of digits when the ball falls through one of said locations representative of said higher level, and said digital display increments by a lesser number of digits when the ball falls through one of said locations representative of said lower level.

6. A machine according to claim 5 wherein said table has a front end and a rear end, the rear end being higher than the front end and the rear end having said apertures, so that if the ball does not fall through an aperture, it will roll back down the table surface to the front of the table, and wherein there is a collecting tray under the table to collect the ball when it falls through an aperture and to return it to the front of the table for re-use.

* * * * *